United States Patent [19]

Stoufer

[11] Patent Number: 4,659,498

[45] Date of Patent: Apr. 21, 1987

[54] SKI AND SURFBOARD WAX REMOVER

[76] Inventor: Wilmer B. Stoufer, 8133 Naranja Dr., Jacksonville, Fla. 32217

[21] Appl. No.: 787,632

[22] Filed: Oct. 15, 1985

[51] Int. Cl.[4] ..... C11D 7/50; C11D 7/24; C11D 9/24

[52] U.S. Cl. ..... 252/153; 252/118; 252/163; 252/170; 252/171; 252/DIG. 14; 252/117

[58] Field of Search ..... 252/118, 122, 126, 127, 252/132, 153, 163, 170, 171, 108, 117

[56] References Cited

U.S. PATENT DOCUMENTS 175,976 4/1876 Harrison ..... 252/118
1,710,974 4/1929 Hager et al. ..... 252/126

FOREIGN PATENT DOCUMENTS 25400 2/1982 Japan .
219399 12/1984 Japan .
491960 9/1938 United Kingdom .
493611 10/1938 United Kingdom .

*Primary Examiner*—Prince E. Willis
*Attorney, Agent, or Firm*—Sturges, R. A.

[57] ABSTRACT

There is provided an improved wax removing composition especially useful for removing wax from the top surface of surfboards, and a method of removing was utilizing the composition. The composition consists essentially of a major amount of a terpene hydrocarbon, and minor amounts of one or more fatty acids, e.g., tall oil acids, and rosin. A wetting agent, e.g., triethanolamine may also be included to aid in removal of the wax—solution from the surface after application. The principal advantages are that the composition provides a nonpetroleum product useful to replace beach sand as the means for wax removal and enabling water clean up without leaving a residue.

16 Claims, No Drawings

SKI AND SURFBOARD WAX REMOVER

This invention relates as indicated to a composition especially adapted for the removal of wax applied to the working surfaces of amusement devices such as water skis, snow skis, surfboard, sailboats, etc.

BACKGROUND OF THE INVENTION AND PRIOR ART

It is common practice to apply wax to skis to reduce friction over snow or water and to the upper surface of water skis and surfboards to improve grip between the user's feet and the upper surface. For various reasons such as partial removal in use it is desirable to replace the wax coating from time-to-time. Best results are obtained when the residue or build-up from multiple previously applied coats, is completely removed prior to rewaxing. In the case of surfboards, the common practice has been to rub the surface with sand to remove the wax prior to application of a fresh coat. Solvent removers are known, but these leave a residue, and are generally more costly.

Ordinarily, the waxes used for these purposes are hard waxes, such as paraffin wax, carnauba wax, beeswax or mixtures thereof.

I have now found an effective solvent-type wax remover that is easy to use, leaves no residue on the surface, is free of petroleum components, is relatively inexpensive, and when used may be rinsed with water and leave no filmy residue.

BRIEF STATEMENT OF THE INVENTION

Briefly stated, the present invention is in a wax remover composition consisting essentially of a major amount of a normally liquid terpene hydrocarbon and minor amounts of a fatty acid or a mixture of fatty acids containing from 10–20 carbon atoms and rosin. Preferably a surface active agent, e.g., a water soluble salt of a fatty acid, rosin or a mixture fatty acids, or an alkanolamine, or a sulfonate soap, or a polyol, etc., may be included in the composition in a small amount. The invention also contemplates a method of removing old wax from a surface whether that surface be wood, fiber glass reinforced resin or metal using as a wax remover and cleaner the above terpenic composition.

DETAILED DESCRIPTION OF THE INVENTION

As indicated above, the invention is in a novel wax removing composition consisting essentially of a major amount, e.g., 50% to 95% of a normally liquid terpene hydrocarbon, and small amounts of $C_{10}$–$C_{20}$ aliphatic carboxylic acids and rosin, to a total of 100% by weight. Small amounts, up to about 10% by weight of the composition of other ingredients, e.g., odorants, surface active agents, bactericides, fungicides, mildewcides, antifouling agents and the like may be included as desired without affecting the operability of the combination of principal ingredients for the intended purposes.

Among the terpene hydrocarbons useful herein are alpha-pinene, beta-pinene, mixtures of alpha and beta-pinene, dipentene, limonene, fenchene, myrcene, dihydromyrcene, terpinolene, etc. These materials are normally liquid terpene hydrocarbons having boiling points at atmospheric pressure of less than 200° C. Mixtures of various terpene hydrocarbons may be used, the proportions not being critical, e.g., 10:90 limonene:dipentene to 90:10 limone:dipentene. This ingredient amounts to from 50% to 95% by weight of the wax removing composition.

Among the $C_{10}$–$C_{20}$ fatty acids, there may be used in the formulations hereof decanoic acid, dodecanoic acid, tetradecanoic and hexadecanoic acid, ricinoleic acid, oleic acid, tall oil fatty acids, stearic acid, palmitic acid, oleic acid, linoleic acid, octadecanoic acid, cosanic acid, or mixtures thereof, and branched chain analogues or isomers of the foregoing. I prefer to use tall oil fatty acids, a mixture of largely oleic and linoleic acids, because of their low cost. The acids are present in the composition in an amount ranging broadly from about 2% to about 40% by weight of the wax removing composition. For best results, the fatty acid or fatty acid mixture (e.g., tall oil fatty acids) is present in an amount ranging from 1% to 12% by weight, preferably from 2% to 8%.

The final essential component is rosin, or an acid derivative of rosin. Rosin is primarily abietic acid. I prefer to use tall oil rosin although wood or gum rosin may be used with equal effectiveness. I may use with equal effectiveness disproportionated rosin, hydrogenated rosin acids, dehydroabietic acid, levopimaric acid, or mixtures thereof. This ingredient is generally present in an amount ranging from 0.5% to about 40% by weight, and preferably in the range of from 2% to 20% by weight.

As indicated above, other normally liquid or soluble ingredients, which confer desired properties on the composition but do not otherwise adversely affect the manner in which the principal ingredients coact together to remove the wax, may be present in small amounts up to 10% by weight, and preferably not more than about 5%. Particularly useful are water soluble wetting agents such as organic amines or alkanolamines solube in the system. These materials aid in removal of the solvent afterwards. Suitable alkanolamines include mono-, di-, and triethanolamine and mixtures thereof, tripropanolamine, etc.

It is convenient at this point to give specific examples of compositions useful in accordance herewith it being understood that these examples are for illustrative purposes only and are not to be construed as limiting the invention to the scope thereof.

| EXAMPLE 1 (Best Mode) | | |
|---|---|---|
| Dipentene | 87.5 | parts by weight |
| Rosin (tall oil derived) | 2.1 | parts by weight |
| Tall Oil Fatty Acids | 6.3 | parts by weight |
| Triethanolamine | 4.1 | parts by weight |
| | 100.0 | |

| EXAMPLE 2 | | |
|---|---|---|
| Limonene | 90 | parts by weight |
| Rosin (tall oil derived) | 2 | parts by weight |
| Tall oil fatty acids | 5 | parts by weight |
| Triton X-100 (Chem. Abs. Reg. No. 9002-93-1) | 3 | parts by weight |
| | 100 | |

| EXAMPLE 3 | | |
|---|---|---|
| alpha-Pinene | 80 | parts by weight |
| Rosin | 10 | parts by weight |
| Tall Oil Fatty Acids | 5 | parts by weight |
| Triethanolamine | 5 | parts by weight |
| | 100 | |

| EXAMPLE 4 | | |
|---|---|---|
| Terpinolene | 55 | parts by weight |
| Stearic acid | 3 | parts by weight |
| Oleic acid | 3 | parts by weight |
| Dipentene | 10.0 | parts by weight |

-continued

| | |
|---|---|
| Rosin (Wood) | 20.0 parts by weight |
| Tween 20 (Chem. Abs. Reg. No. 9005-64-5) | 9.0 parts by weight |
| | 100.0 |

EXAMPLE 5

| | |
|---|---|
| Dipentene | 90 parts by weight |
| Tall Oil Fatty Acids | 7 parts by weight |
| Rosin (Tall Oil) | 3 parts by weight |
| | 100 |

These and other compositions, which can be formulated by those skilled in the art from the foregoing teachings, are normally liquid, and are readily applied by wiping the wax coated surface with a rag having soaked therein an effective amount of the wax remover, or spraying and rubbing the surface until clean. For use, the rag may be saturated with the wax remover composition hereof, or merely dampened as desired. The surface may then be rinsed with water and dried leaving no filmy residue. Thereupon, a fresh application of wax may be made.

What is claimed is:

1. A composition for removing wax from a surface consisting essentially of (a) from more than 50 to 95 parts by weight of a normally liquid terpene hydrocarbon or mixture of terpene hydrocarbons having a boiling point below 200° C., (b) from 2 to 40 parts by weight of a $C_{10}$–$C_{20}$ fatty acid or mixture of $C_{10}$–$C_{20}$ fatty acids, and (c) 3 to 40 parts by weight or rosin or a rosin derivative, to a total of 100 parts by weight for components (a), (b) and (c).

2. A composition as defined in claim 1 wherein component (a) is dipentene.

3. A composition as defined in claim 1 wherein component (b) is tall oil fatty acids.

4. A composition as defined in claim 1 wherein component (c) is rosin.

5. A composition as defined in claim 4 wherein the rosin is tall oil rosin.

6. A composition as defined in claim 1 which is further characterized by the presence therein of (d) less than 10 parts by weight of a water soluble surface active agent dissolved therein.

7. A composition as defined in claim 6 wherein the surface active agent is an alkanolamine.

8. A composition as defined in claim 7 wherein the alkanolamine is triethanolamine.

9. A composition as defined in claim 7 wherein the alkanolamine is selected from monoethanolamine, diethanolamine, triethanolamine and mixtures thereof.

10. A method for removing wax from a surface which comprises the steps of applying to the wax coated surface a wax removing composition consisting essentially of (a) from more than 50 to 95 parts by weight of a terpene hydrocarbon having a boiling point below 200° C., (b) from 2 to 40 parts by weight of a $C_{10}$–$C_{20}$ fatty acid or mixture of $C_{10}$–$C_{20}$ fatty acids, and (c) from 0.5 to 40 parts by weight of rosin; contacting said wax with said wax removing composition until the wax is dissolved and removable; and rinsing the surface with water.

11. The method of claim 10 wherein the wax removing composition is additionally characterized by the presence therein of from 1 to 10 parts by weight of a water soluble wetting agent dissolved therein.

12. The method of claim 11 wherein the wetting agent is an alkanolamine.

13. The method of claim 12 wherein the alkanolamine is triethanolamine.

14. The method of claim 12 wherein the alkanolamine is selected from monoethanolamine diethanolamine, triethanolamine and mixtures thereof.

15. A composition for removing wax from a surface, consisting essentially of (a) about 87.5 parts by weight of a terpene hydrocarbon, (b) about 6.3 parts of tall oil fatty acids, (c) about 21 parts by weight of rosin and (d) about 4.1 parts by weight of triethanolamine.

16. A composition as defined in claim 15 wherein the terpene hydrocarbon is dipentene.

* * * * *